US005778632A

United States Patent [19]

Dinius et al.

[11] Patent Number: 5,778,632

[45] Date of Patent: Jul. 14, 1998

[54] HOPPER ASSEMBLY FOR LITERATURE FEEDER SYSTEM

[75] Inventors: Harold B. Dinius, Mooresville; Jeffrey S. Fluharty, Indianapolis; Donald R. Perryman, Brownsburg, all of Ind.

[73] Assignee: Eli Lilly and Company, Indianapolis, Ind.

[21] Appl. No.: 734,160

[22] Filed: Oct. 21, 1996

[51] Int. Cl.[6] ..... B65B 35/02; B65B 21/00; B65B 35/18

[52] U.S. Cl. ..... 53/157; 53/136.1; 156/DIG. 29; 156/DIG. 31; 221/44; 221/211; 221/281; 221/304; 271/31.1; 271/102; 271/129; 271/138; 271/157; 271/171

[58] Field of Search ..... 53/111 R, 135.1, 53/136.1, 389.1, 157; 156/DIG. 29, DIG. 31; 193/35 G, 33, 34, 25 S; 221/44, 64, 211, 270, 279, 281, 308, 310; 271/138, 99, 304, 102, 150, 31.1, 157, 129, 171

[56] References Cited

U.S. PATENT DOCUMENTS

| | | | |
|---|---|---|---|
| 989,797 | 4/1911 | Peters et al. | 271/99 |
| 2,269,870 | 1/1942 | Carter | 156/DIG. 29 |
| 3,291,483 | 12/1966 | Silver | 156/DIG. 29 |
| 3,380,228 | 4/1968 | Platt | 53/315 |
| 3,527,367 | 9/1970 | Bivans | 271/102 X |
| 3,858,490 | 1/1975 | Heisler | 271/150 X |
| 3,937,458 | 2/1976 | Langen | 271/99 X |
| 3,991,168 | 11/1976 | Richards et al. | 53/157 X |
| 4,109,803 | 8/1978 | Quelch | 271/102 X |
| 4,649,692 | 3/1987 | Tomosue | 53/157 |
| 5,057,066 | 10/1991 | Nagahashi et al. | 271/99 X |

*Primary Examiner*—Horace M. Culver
*Attorney, Agent, or Firm*—Michael T. Bates; David E. Boone

[57] ABSTRACT

A hopper assembly for feeding literature to a literature dispenser. The literature dispenser and a label dispenser are positioned on opposite sides of a conveyor on which products being furnished with literature and labels are transported. The hopper assembly includes a chute which is designed to have an upstream chute portion adjacent the conveyor. The upstream chute portion is positioned within the reach of an operator who is stationed on the same side of the conveyer as the label dispenser, and a single operator can load both the hopper assembly and the label dispenser without moving from one side of the conveyor to the other. The hopper assembly also includes a literature escapement having a plurality of retaining members mounted on a pair of support elements. The retaining members engage a forward facing surface of a piece of literature and are arranged in spaced relationship to provide an opening through which the piece of literature is removable from the hopper assembly in the forward direction. A stud is connected at one end to one of the support elements, and a rotatable knob threadedly on the stud engages the other support element. As an operator rotates the knob, the knob moves along the stud and forces the support elements to move either toward or away from each other to move the retaining members and thereby adjust the size of the escapement opening.

19 Claims, 4 Drawing Sheets

HOPPER ASSEMBLY FOR LITERATURE FEEDER SYSTEM

BACKGROUND OF THE INVENTION

The present invention pertains to machines for packaging materials, and, in particular, to machines used to place literature such as outserts onto products.

A variety of differently configured, dedicated machines have been developed to automate and thereby speed the process of packaging products. In the pharmaceutical industry, the products being packaged often take the form of containers or bottles filled with pill-type dosages of medication. During the packaging process, labels which among other things identify the containers' contents are typically adhesively applied to the exterior surfaces of the containers.

To provide users with additional information about the packaged medication, pharmaceutical companies have supplemented conventional container labels with printed literature that accompany the containers. This literature may be produced by first appropriately printing selected information on relatively large sheets of paper and then folding the sheets into compact, more convenient sizes for inclusion in the product packaging. Besides taking the form of inserts which are separately placed with containers in additional cartons or packaging, literature has been supplied as outserts which are adhesively attached to the containers. This adhesive is designed to allow a user to peel off the outsert from the container and then unfold the outsert to allow study of the entire printed disclosure.

Packaging machines have previously employed literature hoppers to feed a supply of literature, such as outserts, to literature dispensers that then transfer the literature to the containers. At their feed ends where the literature passes to the literature dispensers, hoppers have been equipped with escapement devices which retain the literature for removal by various pick-up device of the literature dispensers.

One prior art literature escapement is illustrated in FIG. 1. The escapement includes plates 10, 11 securely fixed to side rails 13, 14, respectively. Base skid 15 and side rails 13, 14 define the hopper chute into which is loaded a supply of literature indicated in dashed lines at 16. Retaining fingers 18 and retaining fingers 19 engage the forward face of the most forward piece of literature of the loaded supply. Retaining fingers 18, 19 are adjustably mounted to plates 10 and 11 via thumbscrews 21, and slots provided in plates 10, 11 allow retaining fingers 18, 19 to be secured at different plate heights.

A laterally extending flange 22 fixed to side rail 13 includes a slot through which thumbscrew 25 extends to a tapped bore in a rigid base plate 28 fixedly mounted to the literature dispenser. Side rail 14 similarly includes a laterally extending flange 23 with a slot through which thumbscrew 26 connects to base plate 28. A brace plate 30 spans the top edges of plates 10, 11 and is secured via thumbscrews 32, 33 which extend through a common slot and insert into tapped bores in plates 10, 11.

On occasion, the escapement must be adjusted to accommodate different width pieces of literature, or to change the depth of engagement of the literature by the retaining fingers 18, 19 to thereby alter the force required to pull the held outsert past the fingers and out from the escapement. To adjust the width of the escapement of FIG. 1, an operator first loosens thumbscrews 25, 26 and thumbscrews 32, 33. Then, plates 10, 11 are manually shifted laterally toward or away from each other to adjust the width of the space between retaining fingers 18, 19. During this plate shifting, an operator typically attempts to move each of plates 10, 11 an equal amount laterally such that the literature will remain centered for the pick-up device of the literature dispenser. After this escapement adjustment has been performed, thumbscrews 25, 26 are tightened down in order to prevent further motion of plates 10 and 11 relative to base plate 28, and thumbscrews 32, 33 are tightened to prevent relative movement between the plates 10, 11. If further adjustments are required, an operator must repeat the adjustment procedure.

This escapement design suffers from several significant shortcomings. As trial and error is normally the manner in which the escapement is properly set for particular batches of literature, an operator may need to perform the adjustment process several times to properly arrange the escapement, which is inconvenient and results in down time for the packaging system. In addition, because of the manner in which the plates must be manually moved during escapement adjustment, fine adjustments are difficult, and even a careful operator can inadvertently slide the plates too far so as to require an operator to essentially start over. Furthermore, centering of the escapement relative to a pick-up device of the literature dispenser is desirable to ensure proper literature removal. However, the escapement of FIG. 1 requires the operator to visually center the plates.

Another shortcoming of existing literature hoppers is their tendency to be labor intensive to operate. In packaging systems in which a label dispenser and literature dispenser are stationed on opposite sides of a container transporting conveyor belt, literature hoppers are not accessible by persons on the label dispenser side of the conveyor belt. Therefore, separate operators are normally employed to load and maintain the literature dispenser and the label dispenser. Although a single person could in theory load both labels and literature into such a packaging system, that person would have to continuously pass under, over or around the conveyor belt, which would be inconvenient. And, in situations where the person fails to move around to the other side of the conveyor belt before the supply of labels or literature is exhausted, the packaging process must be halted and a loss in productivity results.

Thus, it would be desirable to provide a literature hopper assembly which overcomes these and other deficiencies of the prior art.

SUMMARY OF THE INVENTION

The present invention provides a literature hopper assembly configured to allow a single operator to load a label dispenser and a literature dispenser positioned on opposite sides of a conveyor belt without moving from one side of the conveyor belt to the other side. The inventive hopper assembly also includes an escapement structured to be adjusted by an operator in a convenient and accurate fashion, and which provides a self-centering adjustment.

In one form thereof, the present invention provides a packaging apparatus for products including means for conveying products from a first position to a second position, wherein the conveying means includes a moving conveyor surface on which products are located, means for placing labels on products on the conveyor surface, wherein the label placing means is generally positioned on the first side of the conveyor surface and structured and arranged to be loaded with a supply of labels by an operator situated on the first side, and means for placing literature on products on the conveyor surface, wherein the literature placing means is generally positioned on the second side of the conveyor surface. The system also includes a hopper assembly for feeding literature to the literature placing means, wherein the hopper assembly includes a chute structured and arranged to be manually loaded with a supply of literature by an operator situated on the first side, whereby a single operator can load both the label placing means and the hopper assembly for the literature placing means without leaving the first side of the conveyor surface.

In another form thereof, the present invention provides a literature escapement for retaining a piece of literature loaded in a chute of a hopper assembly in preparation for removal from the hopper assembly by a pick-up device. The literature escapement includes a plurality of retaining members including first and second retaining members, wherein the first and second retaining members are arranged in spaced relationship to provide an opening through which the piece of literature is removable from the hopper assembly in a forward direction, and wherein the first and second retaining members are engagable with a forward facing surface of the piece of literature along first and second opposite edges of the piece of literature. The escapement also includes a means for simultaneously moving both the first and second retaining members to change the size of the opening while generally maintaining a centering of the opening to preserve alignment with the pick-up device, wherein the moving means includes a common adjustment member operable to effect simultaneously movement of both the first and second retaining members.

In still another form thereof, the present invention provides a hopper assembly for feeding literature to a literature dispenser that includes a feeder chute extending between a downstream end and an upstream end, wherein the chute is loadable with a supply of literature upstream of the downstream end. The hopper assembly also includes an escapement at the chute downstream end for presenting a most downstream piece of literature of the supply of literature to the literature dispenser. The escapement includes first and second support members aligned along opposite sides of the feeder chute, a first retaining member projecting from the first support member into the chute for engaging the piece of literature along a first edge, a second retaining member projecting from the second support member into the chute for engaging the piece of literature along a second edge opposite the first edge, a shaft having a length and first and second ends, wherein the first shaft end is connected to the first support member and the shaft includes a threaded portion, and a rotatable member threadedly engaged with the shaft threaded portion and operatively engaging the second support member. The rotatable member moves along the length of the shaft during rotation of the rotatable member to thereby move the first and second support members relative to each other to adjust a spacing between the first and second retaining members through which the piece of literature passes to the literature dispenser.

One advantage of the hopper assembly of the present invention is that it allows a single operator to load a literature dispenser and a label dispenser positioned on opposite sides of a conveyor without leaving the operator's station on the label dispenser side of the conveyor.

Another advantage of the present invention is that the hopper assembly has an extended chute length which allows a greater supply of literature to be loaded at one time.

Still another advantage of the present invention is that the literature escapement is adjustable in a convenient manner.

Still another advantage of the present invention is that the literature escapement allows for fine adjustments, and that the adjustments are self-centering to better ensure a proper literature removal by a pick-up mouthpiece of a literature dispenser.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Figure 1:
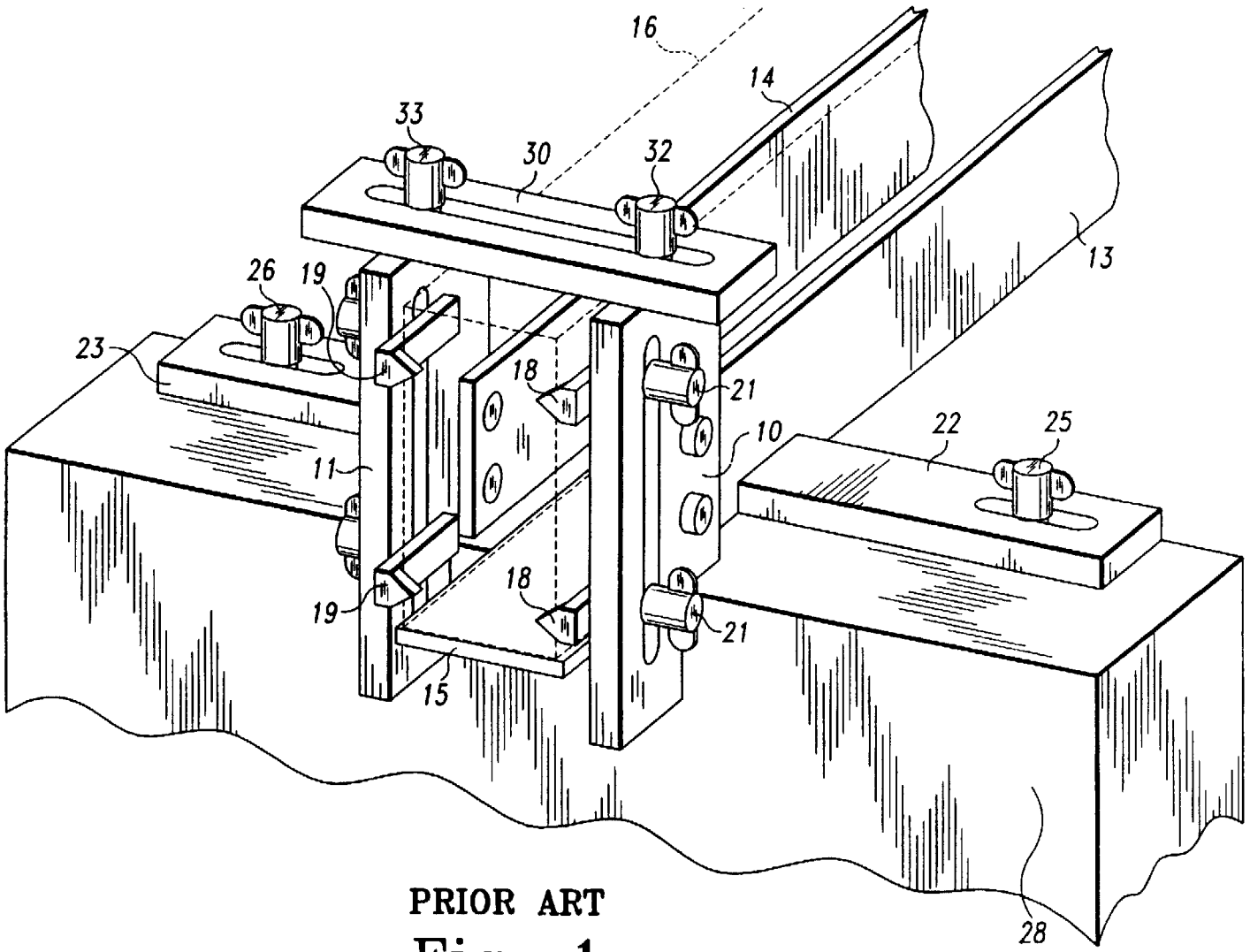
PRIOR ART Fig. 1
FIG. 1 is a perspective view of one type of literature hopper escapement of the prior art.

Corresponding reference characters indicate corresponding parts throughout the several views. Although the drawings represent an embodiment of the invention, the drawings are not necessarily to scale and certain features may be exaggerated or omitted in order to better illustrate and explain the present invention.

DESCRIPTION OF THE PREFERRED EMBODIMENTS

Figure 2:
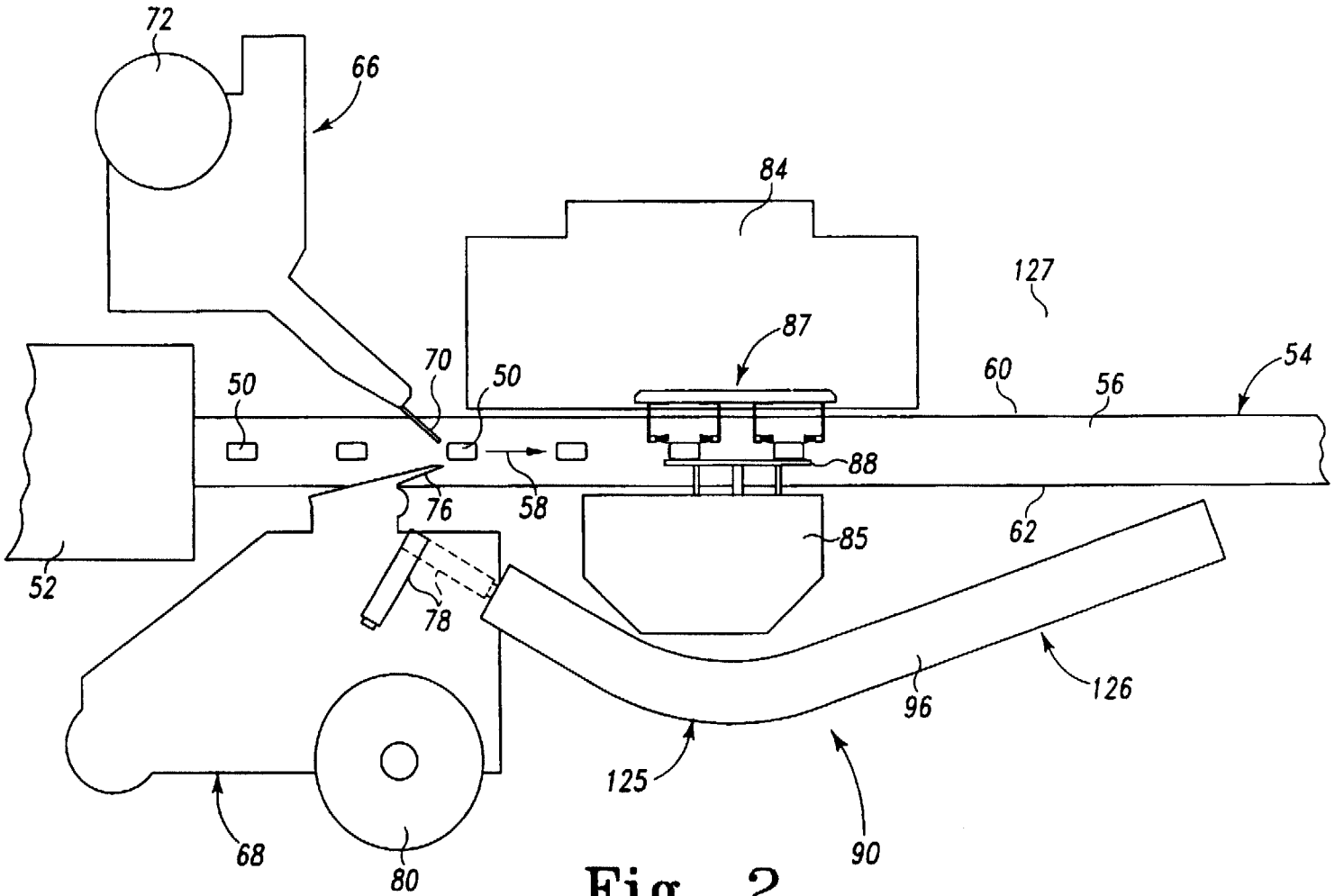
FIG. 2 is a diagrammatic top view of a label and literature dispensing machine in which the literature feeder system employs the hopper assembly of the present invention.

Referring now to FIG. 2, there is shown a diagrammatic top view of selected portion of a packaging system with which the hopper assembly of the present invention is advantageously employed. Certain structural portions of the packaging system which may be of any suitable type known in the art have been abstractly shown or omitted in the interest of clarity of illustration, and further because the construction of such portions are not essential to an understanding of the present invention. With the exception of the inventive hopper assembly, the overall configuration of the packaging system shown in FIG. 2 is well known to those of skill in the art, and packaging systems of this type are commercially available from New Jersey Machine Inc. of Fairfield, N.J. Furthermore, although shown and described with reference to packaging pill containers or bottles, it will be appreciated that this usage is merely illustrative of the present invention and not intended to be limiting. The literature feeding capabilities of the present invention may be advantageously incorporated into other dedicated packaging systems in which labels or literature are applied to other types of products.

A supply of capped bottles 50 prefilled with medication and introduced to feed screw system 52 are released onto a moving conveyor, generally designated 54. Feed screw system 52 functions to properly orient and arrange each bottle 50 in a predetermined, fixed space relationship with its preceding and following bottles. Conveyor 54 includes a horizontally oriented top surface 56 on which bottles 50 are supported and which moves the bottles in the downstream direction generally indicated by arrow 58. Conveyor 54 includes a first side 60 and a second side 62. Conveyor 54 is typically constructed as an endless loop or belt driven by a not shown motorized belt drive, but may be provided in alternate fashions known in the art.

As conveyor 54 moves bottles 50 to the right in FIG. 2, each bottle passes a label dispenser and a literature dispenser, generally designated 66 and 68 respectively. Label dispenser 66 is stationed laterally of conveyor belt first side 60 and includes an applicator member 70 extending over conveyor 54. Applicator member 70 applies an adhesive backed label (not shown) to the presented side surface of a passing bottle 50. A supply of container labels, typically provided in roll form with labels removably mounted on a windable strip of adhesive paper, may be manually loaded into dispenser 66 at dispenser loading region 72 by a system operator.

Literature or outsert dispenser 68 is stationed laterally of conveyor belt second side 62 and includes an applicator section 76 extending over conveyor 54 which is used to attach an outsert or literature piece to the passing bottle 50. In the shown embodiment, when arranged in the position shown in dashed lines, literature pickup mouthpiece 78 operates to pull or remove a presented piece of literature from an escapement at the downstream end of the hopper assembly, generally designated 90. This literature removal may be accomplished by mouthpiece 78 using vacuum forces to grip the literature piece, or in any other suitable fashion known in the art. While still holding the removed piece of literature, mouthpiece 78 then pivots to the position shown in solid lines where the vacuum is released to deliver the literature piece to a passing adhesive coated tape (not shown) supplied from a supply roll loaded at the dispenser region indicated at 80. When the adhesive coated tape with the attached literature piece proceeds to pass over the distal end of the applicator section 76 near the centerline of the conveyor, the literature piece detaches from the tape and is adhesively applied to another presented side surface of bottle 50 by way of adhesive transferred to the literature piece from the adhesive tape.

After being conveyed between label dispenser 66 and literature dispenser 68 such that a label and outsert are placed on its opposite side surfaces, bottle 50 proceeds to pass between cooperating portions 84, 85 of an oscillating pressure station. Station portion 84 includes a brush assembly 87 used to wipe the applied label against the bottle 50 to ensure the label is properly adhered to the bottle. Station portion 85 includes a pressure plate assembly 88 which presses the literature piece against bottle 50 to ensure adhesion while simultaneously providing resistance against forces applied by brush assembly 87 to the passing bottle 50. Brush assembly 87 and pressure plate assembly 88 are designed to oscillate in tandem and in conjunction with the passing bottles 50 so as to not disrupt the movement of the bottles via conveyor 54.

After bottles 50 are conveyed through the oscillating pressure station, conveyor 54 continues to carry the bottles on down the assembly line for further packaging.

Figure 3:
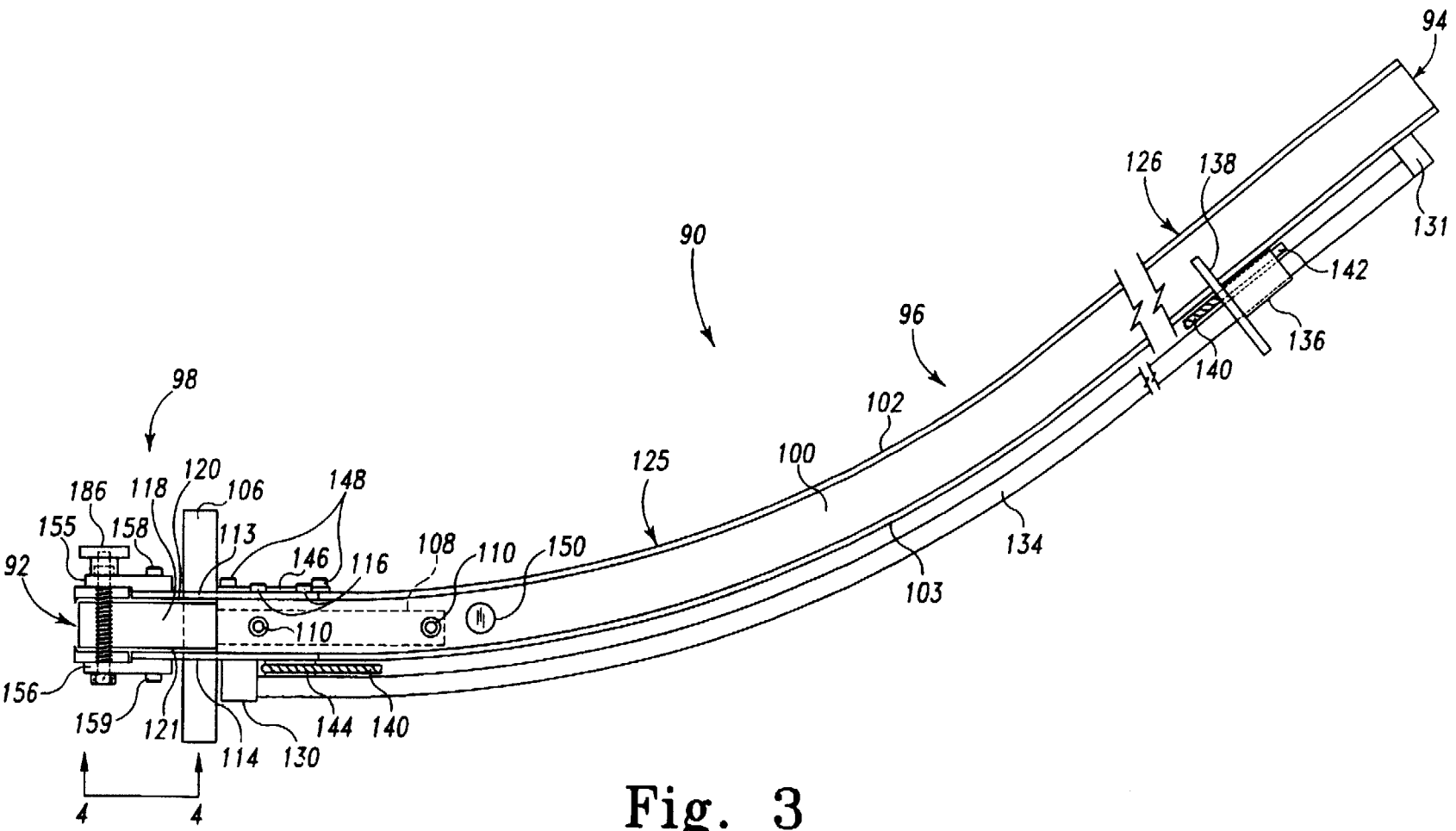
FIG. 3 is a top view of the hopper assembly of FIG. 2 removed from the remainder of the literature dispenser.

As further shown in the top view of FIG. 3 in which it is shown removed from the packaging system, hopper assembly 90 includes a first end 92 and a second end 94. Based upon the direction in which a supply of literature loaded into hopper assembly 90 moves as it feeds literature dispenser 68, first end 92 is the downstream end and second end 94 is the upstream end. Hopper assembly 90 includes a literature chute, generally designated 96, into which may be loaded a supply of vertically oriented literature pieces that are in a horizontally stacked arrangement. Literature chute 96 terminates at a literature escapement, generally designated 98, which holds back or retains the most downstream piece of literature for pick-up by mouthpiece 78.

Literature chute 96 includes a base skid 100 made of a low friction material. Base skid 100 provides a horizontally arranged, planar surface upon which the bottom edges of the literature readily slide. A preferred material for base skid 100 is a one inch thick piece of Delrin® type plastic. Vertically extending side skids or rails 102 and 103 flank base skid 100 along the majority of the skid length. Side rails 102, 103 consist of one-eighth inch thick aluminum slats and are secured to the opposite sides of base skid 100 via fasteners (not shown) such as screws. Side rails 102, 103 and base skid 100 together form a U-shaped structure in transverse cross-section which defines a channel in which the loaded literature supply is transported.

By way of gusset 108, base skid 100 is mounted to a support plate 106 secured to literature dispenser 68. At one end, gusset 108 is attached to plate 106 with fasteners (not shown), and base skid 100 is mounted on gusset 108 via socket head cap screws 110. Cap screws 110 insert from above and recess into counterbores provided in the top surface of base skid 100 to avoid interfering with the literature sliding along skid 100 during operation.

Near the downstream end of base skid 100, side rails 102, 103 end and the literature chute sides are defined by flexure rails 113, 114 that project beyond the end of base skid 100. Flexure rail 113 is attached to the side of base skid 100 with cap screws 116 and upwardly extends to a height equal to rail 102. Flexure rail 114, which upwardly extends to a height equal to rail 103, is attached to the side of base skid 100 with flat head screws (not shown) to avoid interfering with the shuttle assembly described further below.

Flexure rails 113, 114 flank a base plate 118 made of Delrin® plastic. Base plate 118 nests within a recess in the upper face of support plate 106 and is attached to plate 106 with not shown fasteners. Base plate 118 has a uniform thickness of between about ⅜ inch and ½ inch. Gaps 120, 121 between flexure rails 113, 114 and base plate 118 permit slight lateral deflections of the downstream rail ends which allow for escapement adjustment as described further below.

Literature chute 96 is horizontally arranged along its entire length and includes a curved segment, generally designated 125, which begins at the downstream end of side rails 102, 103. Curved or arc shape chute segment 125 has a radius of curvature of 24.75 inches, and segment 125 spans an included angle of 40∞ of the radius of curvature. Upstream of curved chute segment 125, the remaining segment 126 of literature chute 96 is straight and of a length such that end 94 is located at a point adjacent conveyor side 62. Curved chute segment 125 is so configured to bend around oscillating pressure station portion 85 and bring upstream segment 126 of the chute into sufficient proximity to conveyor 54 such that an operator stationed at 127 may conveniently reach across conveyer 54 and load a supply of literature into chute segment 126. Alternate chute bendings or configurations adapted to feed literature dispenser 68 at one end and be loaded with a literature supply by an operator standing on the side of conveyor 54 opposite the dispenser 68 may be substituted within the scope of the invention. For example, rather than a horizontal chute that terminates at an elevation generally equal to that of the conveyor, the chute may be ramped such that its upstream end passes over conveyor 54 to allow ready access by an operator stationed near label dispenser 66. Alternatively, rather than ending at conveyor 54 as shown in FIG. 2, chute 96 in FIG. 2 could be provided with a bend at the shown upstream end and then proceed parallel to conveyor 54 to increase the effective chute length and allow larger quantities of literature to be loaded.

Attached to the side face of base skid 100 are laterally projecting mounting blocks 130, 131 between which extends pole 134. A shuttle 136 slidable along the length of pole 134 includes a literature engaging stop arm 138. The distal end of cable 140 passes through an opening in shuttle 136 and is prevented from pull-back removal through shuttle 136 by a fitting 142 secured to the cable end. Cable 140 is strung over pulley 144 mounted to base skid 100 and down to a tool balance (not shown) which functions to reel in cable 140 such that shuttle 136 is continuously pulled toward downstream end 92 with a substantially constant force. The tool balance is mounted below chute 96 on a downwardly extending mounting plate 146 secured to base skid 100 with cap screws 148.

Shuttle stop arm 138 is pivotable from the shown, operational position projecting into chute 96 to a retracted position out of chute 96 or otherwise clear of literature within chute 96. When in the position shown in FIG. 3, stop arm 138 engages the rearward face of the most upstream piece of literature of the supply loaded in chute 96 and pushes the literature supply toward escapement 98. When stop arm 138 is retracted, an operator can reload chute 96 with literature, pull shuttle 136 to the upstream end of the loaded literature, and then pivot stop arm 138 back into its shown position to reengage the literature supply.

A lens with a photoelectric eye 150 ports through base skid 100 from below and is connected to the computer control for the packaging system. Photoelectric eye 150, which is adapted to sense when literature is directly above it, generates a signal which causes an automatic shut-off of the packaging system, including conveyor 54, when literature is no longer covering the eye. Although not shown, hopper assembly 90 also includes an assembly for pressing the literature down such that the literature bottom edges contact the base skid 100 as the literature approaches escapement 98. Such an assembly is mounted to the side of base skid 100 and includes a generally horizontal plate, suspended an appropriate distance above bas, skid 100, that is designed to engage the top edges of the passing pieces of literature.

Figure 5:
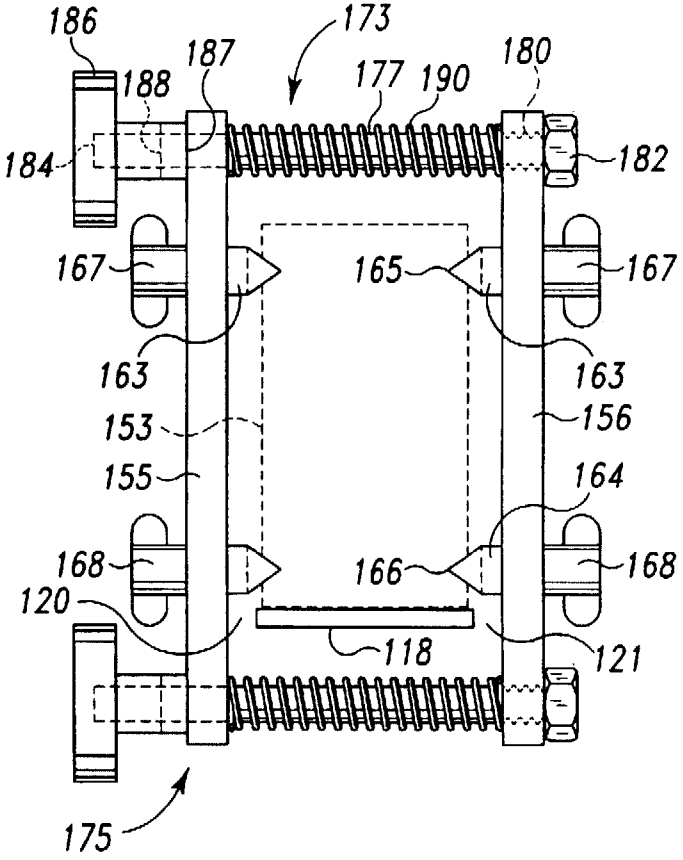
FIG. 5 is a front view of the literature escapement of FIG. 4.
Figure 4:
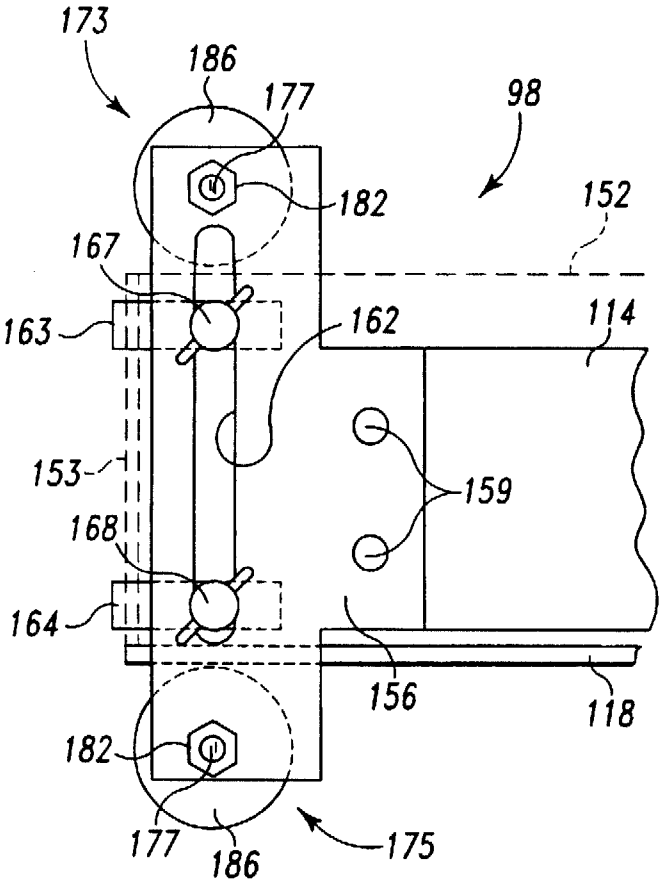
FIG. 4 is a side view, taken along line 4—4 in FIG. 3, further showing the literature escapement of the hopper assembly.

With additional reference to FIGS. 4 and 5, literature escapement 98 will be further described. FIG. 4 is a right side view of the escapement with the most forward or downstream portion of the supply of literature within chute 96 shown in dashed lines at 152. FIG. 5 is a front view of the escapement of FIG. 4 with the most downstream piece of literature presented for removal by pickup mouthpiece 78 shown in dashed lines at 153. Escapement 98 includes mirror image mounting plates 155 and 156 that are fixedly secured to flexure rails 113 and 114 with fasteners 158 and 159, respectively.

As shown in FIG. 4, a vertical flange portion of mounting plate 156 includes an elongate slot 162. An upper retaining finger 163 and a lower retaining finger 164 include bodies with tapped bores into which insert the threaded ends of thumbscrews 167, 168. As shown in FIG. 5, the pointed, inwardly projecting tip portions 165, 166 of fingers 163, 164 serve as stops which abut the forward face of the last piece of literature 153. Slot 162 allows retaining fingers 163, 164 to be secured at selected heights along mounting plate 156 to accommodate different sized literature or to otherwise modify the way a certain sized piece of literature is held. Adjustment is effected by loosening thumbscrews 167, 168, moving fingers 163, 164 up or down as appropriate while sliding the thumbscrew shafts within slot 162, and then tightening down the thumbscrews 167, 168. Although not shown, mounting plate 155 includes a slot similar to slot 162 of plate 156, and is equipped with retaining fingers and thumbscrews which are identical to those on mounting plate 156 and therefore identically numbered.

The horizontal gap between the pairs of retaining fingers 163 and 164 on the facing mounting plates 155, 156 and through which literature piece 153 is extracted from the hopper assembly 90 may be altered by operation of a pair of adjustment assemblies, generally designated 173, 175. As the construction of assemblies 173, 175 are similar, the following explanation of assembly 173 will be appreciated by one of skill in the art to have equal application to assembly 175.

Adjustment assembly 173 includes a stud 177 which spans the top portions of the mounting plates 155, 156. A threaded end of stud 177 screws into tapped bore 180 of mounting plate 156, and a jam or lock nut 182 screwed onto the projecting end of stud 177 and into contact with plate 156 prevents rotation of stud 177 relative to the mounting plates. Stud 177 freely extends through an opening in mounting plate 155 and projects therefrom. A torque knob 186 includes a threaded bore which engages the threaded end 184 of stud 177. In a preferred embodiment shown, the threaded bore is provided by integrating a vibration resistant nut 188, such as a Nylok® nut, into the molded plastic knob 186. The vibration resistance of nut 188 prevents it from loosening and thereby altering the selected literature escapement opening during operation. While the inward face 187 of knob 186 is shown directly abutting the outwardly facing surface of mounting plate 155, intervening spacers may also be provided. Rotation of knob 186 causes it to move along the axial length of stud 177.

A biasing member is preferably provided to ensure the top portion of mounting plate 155 remains in contact with knob 186 during use. As best shown in FIG. 5, a compression spring 190 axially mounted on stud 177 contacts the inward facing surfaces of mounting plates 155, 156. Other types and mountings of biasing members, such as a leaf spring adjacent stud 177, may naturally be employed within the scope of the invention.

The structure of escapement 98 will be further understood in view of the following explanation of its operation. When it is desired to change the size of the escapement opening, for example when markedly different sized outserts are required or when a new batch of outserts within the chute are folded somewhat differently so as to be slightly different in size, adjustment assemblies 173, 175 may be operated. When knob 186 is rotated counter-clockwise from the perspective of a FIG. 4 viewer, knob 186 moves down stud 177 toward the stud end secured with jam nut 182. This knob translation results in the top portions of mounting plates 155 and 156 moving toward each other. While the flexibility of flexure rails 113, 114 and provided gaps 120, 121 permit this plate movement in the shown embodiment, mounting plates 155, 156 may alternatively be mounted on rigid rails and made of a flexible material to allow adequate plate bowing to realize the necessary movement. As the top portions of plates 155, 156 move toward each other, the upper retaining fingers 163 secured to the plates consequently move toward each other and in the direction of the literature width to reduce the width of the literature opening. An opposite rotation of knob 186 widens the escapement opening. It will be recognized that the rotation of a single knob 186 achieves a simultaneously adjustment or movement of both opposing retaining fingers 163. In addition, because mounting plate 155 and flexure rail 113 are similarly constructed to mounting plate 156 and flexure rail 114, each of the upper retaining fingers 163 moves an equal amount relative to literature piece 153 and base plate 118. As a result, the centering of the opening through which pickup mouthpiece 78 pulls outsert 153 is automatically performed during opening adjustment.

After operation of adjustment assembly 173 to move retaining fingers 163, an operator may similarly operate adjustment assembly 175 to adjust the spacing of retaining fingers 164 generally independent of upper retaining fingers 163.

Alternate adjustment assembly constructions which are not shown may be employed within the scope of the invention to provide for a simultaneous self-centering movement of facing retaining fingers by manipulation of a single adjustment member. For example, rotatable knob 186 may be replaced with an accessory which translates without rotation along stud 177 or a more complementarily structured corresponding element. Furthermore, with appropriate stud and bore threadings, a spanning stud may threadedly engage tapped bores in the top portions of both mounting plates 155, 156 in such a fashion that rotation of the stud realizes movement of both plates 155, 156 along the stud. Still further, the retaining fingers could be adapted to include threaded bores which engage a rotatable stud. When the fingers are fixed to prevent revolution, the fingers move in opposite axial directions along the stud upon stud rotation.

While this invention has been shown and described as having multiple designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A packaging apparatus for products comprising:

means for conveying products from a first position to a second position, said conveying means comprising a moving conveyor surface on which products are located, said conveyor surface comprising first and second opposite sides;

means for placing labels on products on said conveyor surface, said label placing means generally positioned on said first side of said conveyor surface and structured and arranged to be loaded with a supply of labels by an operator situated on said first side;

means for placing literature on products on said conveyor surface, said literature placing means generally positioned on said second side of said conveyor surface; and a hopper assembly for feeding literature to said literature placing means, said hopper assembly comprising a chute structured and arranged to be manually loaded with a supply of literature by an operator situated on said first side, whereby a single operator can load both said label placing means and said hopper assembly for said literature placing means without leaving said first side of said conveyor surface.

2. The packaging apparatus of claim 1 wherein said hopper assembly includes a literature escapement at a downstream end of said hopper assembly chute, said literature escapement structured and arranged to present a piece of literature at a downstream end of the supply of literature loaded into said chute for removal by a pick-up module of said literature placing means, said literature escapement comprising a plurality of retaining members including first and second retaining members for engaging a downstream face of the piece of literature along first and second opposite edges of the piece of literature, and means for simultaneously moving both said first and second retaining members to adjust a spacing therebetween for literature removal by operation of a single adjustment member.

3. The packaging apparatus of claim 2 wherein said literature escapement further comprises a first component supporting said first retaining member, a second component supporting said second retaining member, wherein said means for simultaneously moving both said first and second retaining members comprises a spanning member operatively connected to said first component and extending through an opening in said second component, and wherein said single adjustment member comprises a rotatable element threadedly engaged with a threaded portion of said spanning member.

4. The packaging apparatus of claim 3 wherein said means for simultaneously moving both said first and second retaining members further comprises a means for biasing said first component away from said second component.

5. The packaging apparatus of claim 2 wherein said plurality of retaining members includes third and fourth retaining members for engaging the downstream face of the piece of literature along the first and second edges of the piece of literature, said first and second retaining members positionable proximate a third edge of the piece of literature and said third and fourth retaining members positionable proximate a fourth edge of the piece of literature, and means for simultaneously moving said third and fourth retaining members generally independent of said first and second retaining members to adjust a spacing between said third and fourth retaining members for literature removal by rotating a single second adjustment member.

6. The packaging apparatus of claim 1 wherein said hopper assembly chute comprises a curved chute segment configured to bring a second segment of said chute located upstream of said curved segment in closer proximity to said conveyor surface than said curved chute segment.

7. The packaging apparatus of claim 6 wherein said curved chute segment comprises a radius of curvature of about 24.75 inches.

8. The packaging apparatus of claim 6 wherein said chute is horizontally arranged along its entire length.

9. A literature escapement for retaining a piece of literature loaded in a chute of a hopper assembly in preparation for removal from the hopper assembly by a pick-up device, the literature escapement comprising:

a plurality of retaining members including first and second retaining members, said first and second retaining members arranged in spaced relationship to provide an opening through which the piece of literature is removable from the hopper assembly in a forward direction, said first and second retaining members engagable with a forward facing surface of the piece of literature along first and second opposite edges of the piece of literature;

means for simultaneously moving both said first and second retaining members to change the size of said opening while generally maintaining a centering of said opening to preserve alignment with the pick-up device, said moving means comprising a common adjustment member operable to effect simultaneously movement of both said first and second retaining members.

10. The literature escapement of claim 9 wherein said moving means comprises first and second support elements from which said first and second retaining members respectively project, and a shaft spanning and operatively connected to said first and second support elements.

11. The literature escapement of claim 10 wherein said shaft includes first and second ends and a threaded portion, wherein said shaft is fixed to said first support element at said first shaft end, and wherein said second shaft end extends through an opening in said second support element and is operatively connected to said second support element by a rotatable knob threadedly engaging said shaft threaded portion, wherein said rotatable knob comprises said common adjustment member.

12. The literature escapement of claim 11 wherein said moving means further comprises a spring mounted on said shaft for biasing said first and second support elements apart.

13. The literature escapement of claim 11 wherein said first and second support elements comprise a flexible construction to permit sufficient bending of said first and second support elements to allow movement of said first and second retaining members.

14. The literature escapement of claim 9 wherein said plurality of retaining members further comprises third and fourth retaining members engagable with the forward facing surface of the piece of literature along the first and second opposite edges of the piece of literature respectively, and further comprising adjustment means for simultaneously moving both said third and fourth retaining members to change the size of an opening therebetween through which the piece of literature is removable from the hopper assembly in the forward direction, said adjustment means comprising a second adjustment member operable to effect simultaneously movement of both said third and fourth retaining members independent of movement of said first and second retaining members.

15. A hopper assembly for feeding literature to a literature dispenser comprising:

a feeder chute extending between a downstream end and an upstream end, said chute loadable with a supply of literature upstream of said downstream end; and an escapement at said chute downstream end for presenting a most downstream piece of literature of the supply of literature to the literature dispenser comprising:

first and second support members aligned along opposite sides of said feeder chute;

a first retaining member projecting from said first support member into the chute for engaging the piece of literature along a first edge;

a second retaining member projecting from said second support member into the chute for engaging the piece of literature along a second edge opposite the first edge;

a shaft having a length and first and second ends, said first shaft end connected to said first support member, wherein said shaft comprises a threaded portion; and a rotatable member threadedly engaged with said shaft threaded portion and operatively engaging said second support member, wherein said rotatable member moves along the length of said shaft during rotation of said rotatable member to thereby move said first and second support members relative to each other to adjust a spacing between said first and second retaining members through which the piece of literature passes to the literature dispenser.

16. The hopper assembly of claim 15 wherein said rotatable member abuts a surface of said second support member facing away from said first support member, and wherein said escapement further comprises a means for biasing said first support member and said second support member apart.

17. The hopper assembly of claim 15 further comprising means for positioning said first retaining member and said second retaining member at different heights along said first support member and said second support member respectively, whereby regions of engagement of the piece of literature by said first and second retaining members along the first and second edges of the piece of literature are adjustable.

18. The hopper assembly of claim 15 further comprising third and fourth retaining members respectively projecting from said first and second support members into the chute for engaging the piece of literature along the first and second edges respectively, a second shaft connected to said first support member and including a threaded portion, and a second rotatable member threadedly engaged with said second shaft threaded portion and operatively engaging said second support member, wherein said second rotatable member moves along said second shaft during rotation of said second rotatable member to thereby move said third and fourth retaining members relative to each other to adjust a spacing therebetween through which the piece of literature passes to the literature dispenser.

19. The hopper assembly of claim 18 wherein said first and second retaining members are positioned along an upper portion of said first and second support members, wherein said third and fourth retaining members are positioned along a lower portion of said first and second support members, and wherein said upper portions of said first and second support members are generally movable relative to said lower portions of said first and second support members.

* * * * *